United States Patent [19]

Gudelis et al.

[11] B 4,013,542

[45] * Mar. 22, 1977

[54] PARTIAL PREDILUTION-DILUTION CHILLING

[75] Inventors: David A. Gudelis; David H. Shaw, both of Sarnia, Canada

[73] Assignee: Exxon Research and Engineering Company, Linden, N.J.

[ * ] Notice: The portion of the term of this patent subsequent to Nov. 26, 1991, has been disclaimed.

[22] Filed: Oct. 21, 1974

[21] Appl. No.: 516,625

[44] Published under the second Trial Voluntary Protest Program on March 30, 1976 as document No. B 516,625.

Related U.S. Application Data

[63] Continuation-in-part of Ser. No. 284,647, Aug. 29, 1972, Pat. No. 3,850,740.

[52] U.S. Cl. ..... 208/33

[51] Int. Cl.[2] ..... C10G 43/08

[58] Field of Search ..... 208/33

[56] References Cited

UNITED STATES PATENTS

| | | | |
|---|---|---|---|
| 2,410,483 | 11/1946 | Dons et al. | 208/33 |
| 3,642,609 | 2/1972 | Mayer et al. | 208/33 |
| 3,644,195 | 2/1972 | Gudelis et al. | 208/33 |
| 3,681,230 | 8/1972 | Eagen et al. | 208/33 |
| 3,850,740 | 11/1974 | Gudelis et al. | 208/33 |

*Primary Examiner*—Herbert Levine
*Attorney, Agent, or Firm*—Edward M. Corcoran

[57] ABSTRACT

A dewaxing process is described wherein a waxy petroleum oil stock such as residual or a broadcut feedstock, characterized by containing at least 10% of residual material boiling above about 1000° F., is mixed with at least about 0.3 volumes of a dewaxing solvent per volume of waxy oil stock, thereby depressing the cloud point of same.

In one embodiment of the invention, the resultant mixture is introduced into a cooling zone, at a temperature above the depressed cloud point of the oil. Precooled dewaxing solvent is incrementally added to the cooling zone which is divided into a plurality of stages with agitation means present in each of the stages. The resultant solvent-oil mixture is cooled and agitated as it passes through the cooling zone, thereby reducing the temperature of the oil to below its depressed cloud point and precipitating at least a portion of the wax therefrom. An oil stock of diminished wax content is thereafter recovered.

In a second embodiment of the invention, the waxy oil stock is introduced into the cooling zone in the absence of solvent at a temperature above the cloud point of the oil. Precooled dewaxing solvent is introduced incrementally into the initial stages of the cooling zone, coming into contact with the waxy oil and depressing its cloud point. The oil is gradually cooled to a temperature no less than the depressed cloud point of the oil whereupon additional precooled dewaxing solvent is added to the oil in the remaining stages of the cooling zone, thereby gradually cooling the oil to a temperature below the depressed cloud point and precipitating at least a portion of the wax therefrom.

7 Claims, 2 Drawing Figures

Figure I

MEK/TOLUENE (55/45) DILUTION CHILLING ARAMCO 2500 BRIGHT STOCK
FEED FILTER RATE VERSUS PREDILUTION

PARTIAL PREDILUTION-DILUTION CHILLING

CROSS-REFERENCE TO RELATED APPLICATION

This application is a continuation-in-part of application Ser. No. 284,647, filed Aug. 29, 1972 now U.S. Pat. No. 3,850,740.

FIELD OF THE INVENTION

This invention relates to a process for the dewaxing of a waxy petroleum oil stock containing at least 10% residual material. More particularly, this invention relates to a solvent predilution dewaxing process wherein a waxy petroleum oil stock containing residual material is admixed with a solvent prior to the cooling of the oil to a temperature below its depressed cloud point.

DESCRIPTION OF THE PRIOR ART

It is known in the prior art to dewax petroleum oil stocks by cooling an oil-solvent solution in scraped surface exchangers. In this process the oil and selective solvent are admixed at a temperature sufficient to effect complete solution of the oil and its contained wax in the solvent. The extend of dilution is dependent upon the particular oil and solvent employed and is adjusted to facilitate easy handling and optimum filtration rates and oil yields. The solution is cooled at a uniformly slow rate, e.g., 1° to 5°F. per minute, under controlled conditions so as to avoid any substantial agitation of the solution during precipitation of the wax. Notwithstanding the carefully controlled conditions used in this process, there are several deficiencies which hamper successful commercial operation. Most significant among these defificiencies is the loss of good heat transfer due to wax deposition on the exchange surfaces. Such failing has been repeatedly noted after short periods of operation, e.g., 24 to 48 hours. Associated directly with the loss of good heat transfer is the loss of careful control of the cooling rate and the corresponding loss of uniform crystal growth. This non-uniform crystal growth results in lower filtration rates. The high-pressure drop through the chilling section also reduces the maximum feed rate obtainable. Physical mashing of the wax crystals by the action of the scrapers may also contribute to poor filtration.

It is also known in the prior art to dewax petroleum oil stocks by cooling same in scraped surface exchangers using an incremental solvent addition technique. In this process, the solvent is added at several points along the chilling apparatus. The waxy oil is chilled without solvent until some wax crystallization occurs and the mixture thickens considerably. The first increment of solvent is introduced at this point and cooling continues. Each incremental portion of solvent is added, if necessary, to maintain fluidity until the desired separation temperature is reached, at which point the remainder of the solvent desired for filtration is added.

Using this common industrial technique, it is well known, and has been repeatedly demonstrated, that the temperature of the solvent should be the same as that of the main stream at the point of addition. Having the solvent at a lower temperature causes shock chilling of the slurry at that point, with resulting formation of crystal fines, and impairment of filter rate; having the solvent warmer throws an unnecessary additional load on the scraped surface chillers. The bulk of the chilling of the slurry in this well-known process is accomplished through the walls of the scraped surface chillers rather than by means of cold solvents.

It is also known in the art, as described in U.S. Pat. No. 2,361,503 to Schutte et al, to subject lubricating oil fractions to agitation in a multi-staged tower with water or brine, which serves as the cooling medium. This process suffers from the disadvantage that the cooling medium is completely immiscible with the wax and oil, and rapid separation occurs between the feed and water unless the mixture is maintained in an agitated state or is emulsified. The use of water as a cooling medium also practically limits the process to an up-flow operation. In U.S. Pat. No. 2,410,483 to Dons et al, a two-stage dewaxing process is described wherein a wax-containing oil stock, heated above its cloud point, is introduced into an elongated cooling vessel divided into a plurality of stages. Cold dewaxing solvent is injected into each of the stages thereby cooling the oil. The resultant oil solvent/mixture is withdrawn from the cooling vessel at the temperature of the cloud point of the oil or no more than about 10°F., above the cloud point. This mixture is then introduced into a pipe wherein additional cold dewaxing solvent is added thereto in the substantial absence of any agitation, thereby cooling the oil to below its cloud point and precipitating wax therefrom. The process contemplates no substantial agitation in the cyrstallization phase of the dewaxing process. As a consequence, the filtration rates are inferior to other dewaxing processes.

In U.S. Ser. No. 129,973, filed Mar. 31, 1971, now U.S. Pat. No. 3,773,650, which application is a C.I.P. of U.S. Ser. No. 17,869, filed Mar. 9, 1970 (now abandoned) which is, in turn, a C.I.P. of U.S. Ser. No. 666,268, filed Sept. 8, 1967 (now abandoned), the disclosures of which are incorporated herein by reference, there is taught a method for dewaxing oils, i.e., "dilution chilling", wherein a waxy oil stock is introduced into a cooling zone divided into a plurality of stages. Dewaxing solvent is introduced into the cooling zone at a plurality of spaced points situated along the cooling zone, coming into contact with the oil. High levels of agitation are provided in at least a portion of the solvent-containing stages, thereby providing substantially instantaneous mixing of the solvent and oil, e.g., within a second or less. As the oil passes through the cooling zone, it is cooled to a temperature sufficient to precipitate at least a portion of the wax therefrom resulting in the formation of a wax slurry wherein the wax particles have a unique crystal structure, thereby providing superior filtering characteristics such as high filter rates and high dewaxed oil yields. While the process of Ser. No. 129,973 overcomes many of the disadvantages of the prior art, it has not been found to be very effective with waxy lubricating oil stocks containing residual material, such as residual bright stocks and broadcut stocks. The filter rates with these oils have been found to be quite low and there is considerable incentive to improving the filterability characteristics of these oils.

SUMMARY OF THE INVENTION

In accordance with the invention, it has now been discovered that waxy lubricating oil feedstocks containing appreciable amounts of residual material can be dewaxed and that substantial improvements in filtration rates can be obtained by use of the solvent predilution process of the subject invention. By residual material is meant that part of the crude, other than asphalt, that has never been volatilized and which has an initial boiling point of above about 1000°–1100°F. at atmospheric pressure.

The process is particularly suitable for "dilution chilling" dewaxing and comprises, in one embodiment of the invention, prediluting a waxy oil with at least about 0.3 volumes of a predilution solvent per volume of oil stock, resulting in the depression of the cloud point of the oil stock. The process feedstock comprises a waxy petroleum oil stock characterized by having at least about 10% of residual material boiling above about 1000°F (all temperatures are reported at atmospheric pressure, unless otherwise stated).

The "cloud point" of the oil is defined as the temperature at which a cloud or haze of wax crystals first appears when an oil is cooled under prescribed conditions (modified ASTM D2500–66 procedure). "Predilution", as the term is used herein, refers to the mixing of solvent and oil prior to cooling of the oil to a temperature below its depressed cloud point.

The resultant solvent-oil mixture is introduced into a cooling zone divided into a plurality of stages, at a temperature above the depressed cloud point of the oil. Additional dewaxing solvent, which may be the same or different than the predilution solvent used to form the initial solvent-oil mixture, is introduced into at least a portion of the stages and high levels of agitation are maintained in at least a portion of the solvent-containing stages thereby providing efficient mixing of solvent and oil. The high levels of agitation referred to above are only necessary during the initial phases of wax crystal nucleation and growth. Once good crystal growth is effected, lower agitation levels may be used, e.g., in the later stages of the cooling zone.

The solvent-oil mixture is cooled as it passes through the cooling zone to a temperature below the depressed cloud point of the waxy oil stock, thereby precipitating at least a portion of the wax therefrom, and a oil stock of diminished wax content is recovered.

In another embodiment of the invention, the predilution of the oil is conducted in situ, i.e., within the cooling zone itself. To this end, the feedstock is introduced into the cooling zone at a temperature above its cloud point and in the substantial absence of solvent. At least about 0.3 volumes of solvent per volume of oil is added to the initial stages of the cooling zone, coming into contact with the oil stock and forming an oil-solvent mixture. The mixture is gradually cooled, as it passes through the initial cooling stages, to a temperature no less than the depressed cloud point of the oil stock. Thereafter, additional solvent is introduced into at least a portion of the remaining stages of the cooling zone, and the oil is further cooled to a temperature below its depressed cloud point thereby precipitating at least a portion of the wax.

Although it is preferred that a substantial portion of the cooling of the oil to be provided by the contacting of same with prechilled solvent, it is contemplated that other cooling means, such as autorefrigeration, wherein cooling is effected in part by vaporization of solvent, may also be employed.

As hereinbefore mentioned, the feedstocks that are used in the process of this invention are those waxy oil stocks containing appreciable (i.e., at least about 10%) amounts of deasphalted residual material. Illustrative but non-limiting examples of such feedstocks are; (a) a residual waxy oil stock having an initial boiling point above about 800°F, with less than about 10% (by weight) of material boiling below about 950°F and less than about 50% (by weight) of material boiling below about 1050°F and (b) broadcut feedstocks produced by topping, i.e., the lightest material is distilled off the crude leaving the remainder which contains appreciable amounts of the residual material more typically found in heavier materials such as resids and bright stocks. Further, the feed may be hydrocracked prior to dewaxing. Preferably, the wax-containing oil is a broadcut, the major portion of which boils above about 650°F.

The residual portion of the oil contains the most difficultly vaporizable components of petroleum hydrocarbons including asphaltenes and pitch, which are undesirable not only in the finished lubricating oil product, but also in the intermediate refining operations, as discussed in more detail infra. It is thus preferred, prior to the dewaxing operation of the subject invention, to remove as much of these components from the oil as possible, such as by a deasphalting operation, e.g, propane deasphalting. Further, the oil may contain aromatic and polar molecules which would impart undesirable properties to the finished lube oil product. These molecules may be removed by using such process techniques as solvent extraction, comparatively severe hydrogen treatment and the like either before or after the dewaxing step.

In general, the wax content of the feedstock as defined by the amount of material to be removed to produce an oil with a pour point in the range of +25° to 0°F. will vary between about 5 and 35 wt. % based on total feed, preferably between about 10 and 30 wt. %. The initial pour and cloud points of the oil will range, respectively, between about 95° and 175°F. and about 100 and 180°F.

The predilution solvent is selected from any of the dewaxing solvents known in the prior art such as the aliphatic ketones having from 3 to 6 carbon atoms, e.g., acetone, methylethyl ketone (MEK), methylisobutyl ketone (MIBK) and the like, the lower molecular weight hydrocarbons such as ethane, propane, butane and propylene, as well as mixture of the foregoing ketones and mixtures of the ketones with hydrocarbon compounds such as propylene, and aromatics such as benzene and toluene. In addition, halogenated low molecular weight hydrocarbons such as the $C_2$–$C_4$ chlorinated hydrocarbons, e.g., dichloromethane, dichloroethane and mixtures thereof, may be used. Specific examples of effective predilution solvents include toluene, MIBK, MEK/toluene, MEK/MIBK and the like.

The depressed cloud point of the oil is dependent, in part, upon the degree of predilution of the oil with solvent and will preferably range between about 50° and 175°F., most preferably between about 50° and 140°F. In general, the amount of predilution solvent added to the oil will be dependent, in part, on the nature of the feedstock, the cooling zone, the extent of cooling within the cooling zone, i.e., approach to the filtration temperature, and the desired final ratio of solvent to oil in the wax/oil/solvent slurry withdrawn from the cooling zone. Preferred amounts of predilution dewaxing solvent range between about 0.3 and 2.0 volumes per volume of oil stock, most preferred between about 0.5 to 1.5 volumes of solvent per volume of oil stock.

The dewaxing solvent that is used during the phase of the dewaxing operation conducted at a temperature below the depressed cloud point of the oil may be the same as or different than the predilution solvent and is selected from the same group of solvents mentioned in connection with the predilution solvents. Specific examples of suitable dewaxing solvent mixtures include methylethyl ketone/methylisobutyl ketone, methylethyl ketone/toluene and propylene/acetone. The preferred solvents are the $C_3$–$C_6$ ketones with methylethyl ketone being particularly preferred. It is noted that when the dewaxing solvent is MEK, a particularly preferred predilution solvent comprises toluene or MIBK.

While all the cooling of the oil stock to the subsequent filtration temperature may take place in the dilution chilling zone, this is not necessarily required for the successful operation of the subject process. In fact only a portion of the cooling need be done therein. Further cooling of the wax/oil/solvent slurry withdrawn from the cooling zone to the filtration temperature may take place in conventional cooling apparatus such as scraped-surface equipment, an autorefrigeration vessel and the like. A description of this aspect of the process is found in U.S. Ser. No. 257,435, filed May 26, 1972 now U.S. Pat. No. 3,775,288, the disclosures of which are incorporated herein by reference.

Quite surprisingly, the predilution process has been found to be specific to waxy oils containing residual material as described hereinabove, and is, in fact, detrimental to the dewaxing of distillates. The term "distillates" as used herein refers to feedstocks that have been completely volatilized and do not contain any residual material.

While the exact mechanism of the predilution process it not known, it is speculated that trace amounts of asphaltene and pitch components present in the residual portion of the feedstocks, possibly as a result of contamination in the vacuum pipestill or inadequate deasphalting, interfere with the formation of wax crystals of the desired structure. Specifically, it is thought that at some temperature above the depressed cloud point of the feedstock, these asphaltene and pitch components precipitate from the oil as very small crystals which interfere with the uniform nucleation and growth of the wax crystals. It is contemplated that solvent predilution facilitates solution of these very small crystals, and delays their precipitation until after the cloud point temperature of the oil is reduced, at which time, they co-crystallize with the wax components of the oil, thereby substantially reducing wax crystal growth interference.

It is also thought that predilution techniques in dilution chilling dewaxing reduce the overall viscosity of the oil stock in the critical early stages of crystal nucleation and growth thereby removing diffusion limitations to crystal growth and facilitating the development of larger particles.

This may be particularly important with the residual and broadcut feedstocks and the like, since the wax crystallizing from such high boiling, high molecular weight feedstocks comprises highly branched paraffins and naphthenes, which have very low crystal growth rates. In contrast, the wax crystallizing from lower boiling distillate feedstocks, generally contains predominantly normal paraffins, which have relatively high crystal growth rates and would therefore not be as sensitive to diffusion limitations.

Further improvements in filter rate may be obtained when dewaxing aids are used in conjunction with solvent predilution for dewaxing these feedstocks. A preferred dewaxing aid comprises a Ziegler-type mixed normal alpha olefin copolymer described in more detail in U.S. Ser. No. 164,892, filed July 21, 1971 now U.S. Pat. No. 3,767,561, having a number average molecular weight between about 2000 and 60,000 or higher, and having pendant side chains of $C_{12}$ and higher. Other dewaxing aids may also be used such as polymeric higher alkyl methacrylates, long-chain alkyl 1,2-oxiranes, polymerized higher fatty acid esters of vinyl alcohol, a mixture of at least two homopolymers of a $C_{14}$–$C_{24}$ alpha olefin, a Friedel-Crafts condensation product of a halogenated hydrocarbon such as chlorinated paraffin wax with an aromatic hydrocarbon such as naphthalene, mixtures thereof and the like.

DETAILED DESCRIPTION

Figure 1:
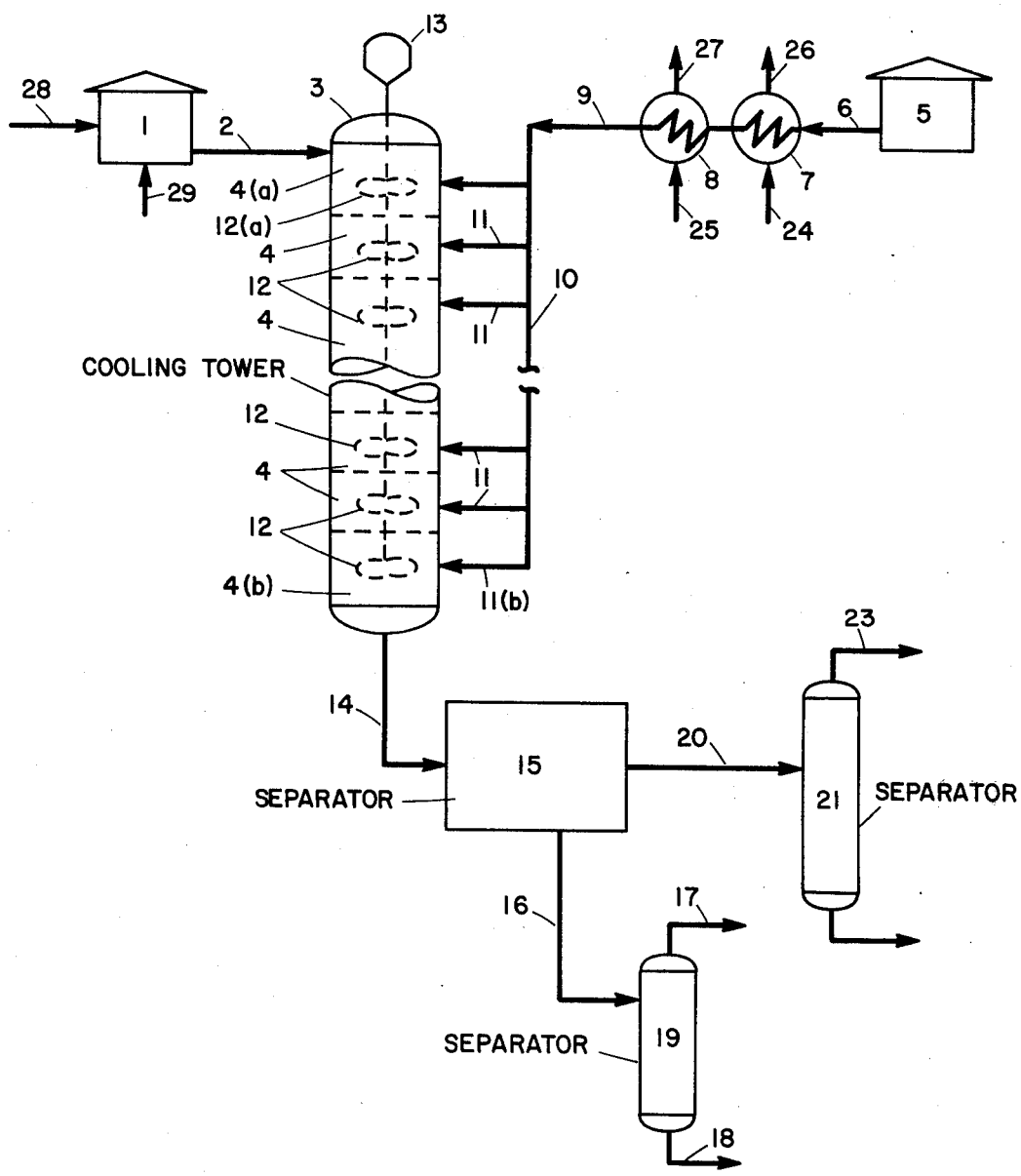
FIG. 1 is a simplified flow scheme of a preferred embodiment of the dewaxing process of the subject invention.

Referring to FIG 1, a waxy lubricating oil stock is taken from tankage and introduced into predilution mixing zone 1 via line 28 while dewaxing solvent is introduced therein via line 29. After a sufficient contact time, the resultant solvent-oil mixture is introduced via line 2 into cooling zone 3, at a temperature above the depressed cloud point of the feedstock. Although not shown, heating means may be provided in mixing zone 1 to ensure that the feed temperature is above the depressed cloud point of the oil prior to introduction into the cooling zone. The cooling zone is depicted herein as a vertical cooling tower; however, it is noted that the design is not limited to this configuration. The solvent-oil mixture enters the cooling tower and into the first stage of the cooler, i.e., 4(*a*). Dewaxing solvent is passed from storage tank 5 through line 6, and heat exchangers 7 and 8, where the solvent temperature is reduced to that sufficient to cool the oil to the desired temperature. Coolant enters the heat exchangers 7 and 8 through lines 24 and 25, respectively and leaves through lines 26 and 27. It will be apparent to those skilled in the art that the exact solvent temperature employed will depend upon the amount of oil to be cooled and the amount of solvent to be added to the oil, i.e., the degree of oil dilution which is sought during the filtration step.

The solvent leaves the heat exchanger 8, through line 9, and enters manifold 10. The manifold comprises a series of spaced solvent inlet points 11 to the several stages of the cooling tower 3. The rate of solvent flow through each inlet is regulated by flow control means (not shown) and is adjusted, so as to maintain a desired temperature gradient along the height of the cooling tower. Preferably, the incremental solvent addition is such that the chilling rate of the oil is below about 10°F./minute and most preferably between about 1° and 5°F./minute. In general, the amount of solvent added thereto will be sufficient to provide a liquid/solid weight ratio between about 5/1 and 100/1 at the dewaxing temperature and a solvent/oil volume ratio between about 1.0/1 and 7/1.

The first portion or increment of solvent enters the first stage, 4(*a*), of the cooling tower 3, where it is substantially instantaneously mixed with oil due to the action of the agitator 12(*a*). The agitator is driven by a variable speed motor 13 and the degree of agitation, as defined in more detail below, is controlled by variation of the motor speed, with due allowance for the flow rate through the cooling tower. It is noted that while a rotating blade is shown as the agitation source, any other mixing means that is able to produce the high levels of agitation required can be used herein. The oil-solvent mixture may pass upwardly or downwardly through the cooling tower 3 (downwardly flow only has been shown). At various heights along the cooling tower, additional prechilled solvent is introduced to each of the several stages 4, through inlets 11 so as to maintain substantially the same temperature drop from one mixing stage to the next and at the same time to provide the desired degree of dilution. It should be noted that any number of stages up to 50 may be employed; however, at least six is preferred.

The cooling of the oil stock continues to a temperature substantially below the depressed cloud point of the oil stock, thereby precipitating at least a portion of the wax therefrom and forming a wax-oil-solvent mixture.

The oil-solvent solution with precipitated wax passes from the final stage of the cooling tower through line 14 to wax separation means 15. If desired, the wax-oil solvent mixture may be further cooled by conventional means not shown. Any suitable separation means such as filtration or centrifugation may be employed. The wax-solvent mixture is removed through line 16 and the solvent recovered therefrom in a suitable separating system 19, which preferably comprises stripping with an inert gas such as nitrogen, steam or air, or straight distillation. The solvent leaves the separator 19 through line 17 and the wax exits through line 18.

The oil-solvent mixture leaves separator 15 through line 20 and passes to oil separation means 21. Any suitable means to effect this separation may be used, such as distillation, selective adsorption, or stripping with an inert gas such as nitrogen, air or steam. The solvent-free oil is removed from the separator and recovered through line 22. The solvent is removed through line 23 and may be recycled directly to the dilution chilling tower or first scrubbed to remove impurities before reuse.

As indicated previously, the degree of agitation, during the initial stages of crystal nucleation and growth, must be sufficient to provide substantially instantaneous mixing of solvent and oil, i.e., preferably within a second or less. The degree of agitation required in the process can be achieved by increasing the agitator rpm, when all other mixing variables, e.g., flow rates through the mixer, vessel and agitator design, viscosity of the ingredients and the like, are maintained constant, so that the modified Reynolds Number (Perry, "Chemical Engineer's Handbook," 3rd, pp. 1224, McGraw-Hill, New York, 1959), $N_Re$, which is defined by the equation:

$$N_{Re} = L2nl/\mu$$

where $L$ = agitator diameter, ft.

$l$ = liquid density, pound/feet$^3$ $n$ = agitator speed, revolution/second $\mu$ = liquid viscosity, pound/feet second ranges between about 200 and about 150,000. The dimensionless ratio of cooling tower diameter to agitator diameter is between about 1.5/1 and about 10/1 and the ratio of the impeller blade length to impeller blade width ranges from about 0.75 to 2 and preferably from about 1 to 1.5. The ratio of the mixing stage height to the diameter of the stage will generally range from about 0.2/1 to about 1/1. A turbine type agitator is preferred, however, other types of agitators such as propellers may be used.

The cooling tower may or may not be baffled, but a baffled tower is preferred. Each stage will generally contain from about two to eight baffles and preferably from two to four baffles, located about the outer periphery of each stage. The width of the baffles may range from about 5 to 15% of the diameter of the tower. In general, the dimensional ratio of the cross-section of the restricted flow opening to the cross-section of the tower will be between about 1/20 and about 1/200.

The cooling tower of the present invention is preferably operated at a pressure sufficient to prevent flashing of the solvent. Atmospheric pressure is sufficient when the ketones are employed as solvent; however, super-atmospheric pressures are required when low molecular weight hydrocarbons such as propylene-acetone and related autorefrigerative solvents are used. As noted above, however, in situations where propylene-acetone and related autorefrigerative type solvents are used, low pressures will be required. A process combining both vaporization of the solvent to provide in situ refrigeration and direct cooling from cold dewaxing solvent is disclosed in U.S. Pat. No. 3,658,688 patented Apr. 25, 1972, the disclosures of which are incorporated herein by reference.

The recovered lube oil products may, if so desired, be subjected to various finishing operations such as clay contacting, hydrofinishing, acid treatment and the like.

PREFERRED EMBODIMENT

The invention will be more apparent from the working examples set forth hereinbelow.

EXAMPLE 1

A laboratory experiment was performed in a 6 inch diameter single stage batch unit provided with a 2 inch diameter flat-bladed turbine impeller, a means for solvent introduction and an overflow device to maintain a constant volume of slurry. This batch unit does not completely duplicate continuous multi-staged operations but has been found to give approximately equivalent results.

The feedstock used in this example was a deasphalted phenol-extracted residual distillation fraction from an Arabian light crude, having less than 10% of material boiling below 975°F. and less than 50% of material boiling below 1150°F. The feedstock had an initial pour point of 145°F., an initial cloud point of 150°F., a viscosity at 210°F. of 140 SUS, and required removal of 15% (wt.) dry wax to give a bright stock lubricating oil product with a +20°F. pour point. This feed is hereinafter referred to as an Aramco 2500 bright stock.

Methylethyl ketone/toluene, 55/45 LV%, was used as both the predilution solvent and as the dewaxing solvent during the chilling operation. The solvent composition in the dilution chilling dewaxing operation was adjusted to obtain approximately a 4:1 final solvent/oil dilution ratio. Other variables such as average chilling rate, agitation levels and the like are displayed below in Table I. Excess slurry comprising precipitated wax, oil and solvent was allowed to overflow the apparatus. When the slurry reached a specified temperature, the contents were drawn off and chilled further by conventional means in order to reach a common filtration temperature.

Figure 2:
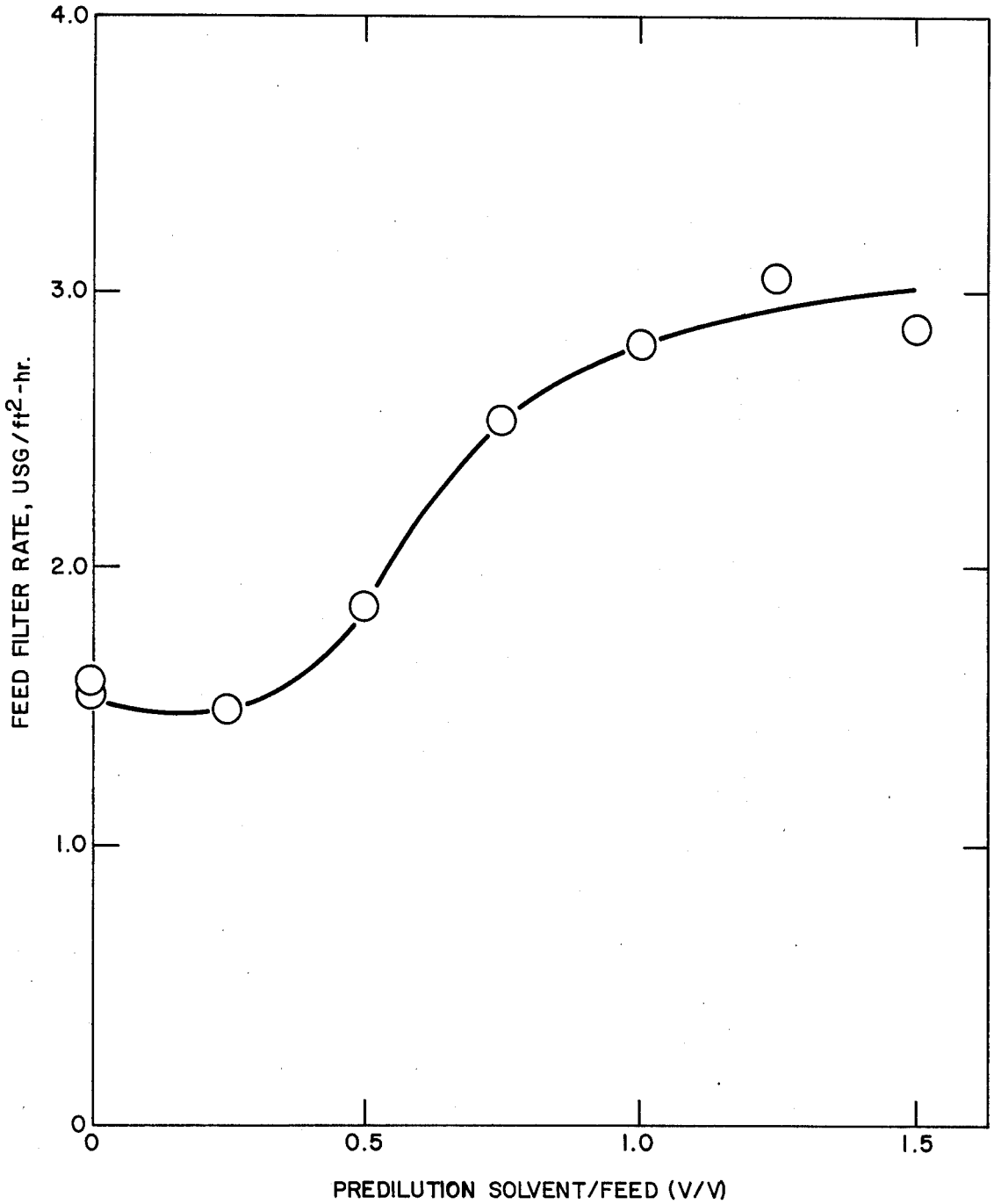
FIG. 2 is a graph relating filter rate to the amount of predilution in MEK/toluene dilution chilling dewaxing of an Aramco 2500 bright stock.

The data show that with predilution in the range of 0.5 to 1.5 volumes of solvent/volumes of oil, DWO filter rates were increased by nearly 100%. The data, which have been graphed and are displayed in FIG. 2, show the tremendous enhancement in filtration rate when predilution is used. It is further noted that the major improvement is observed in the filtration rate as opposed to the dewaxed oil yields which remain fairly constant throughout the various runs.

mixtures of methylethyl ketone and toluene perform as well, if not better than pure solvent systems such as toluene in carrying out the process objectives. The advantage of using toluene rather than MEK/toluene (55/45 LV%) as the predilution solvent relates to the greater cloud point depression obtained with toluene for a given ratio of predilution solvent/feed. Since the predilution solvent, in addition to the feed, has to be chilled from a few degrees above the depressed cloud point to the filter temperature, there are obvious savings in refrigeration from operating with the lowest possible depressed cloud point.

The use of a single solvent composition for predilution and dilution chilling has the obvious advantage

TABLE I

MEK/TOLUENE (55/45 LV%) DILUTION CHILLING DEWAXING OF ARAMCO 2500 BRIGHT STOCK

Laboratory Simulation of a 16 Stage Dilution Chilling Tower
Stage volume 1500 ccs - Impeller - centrally mounted - 2" diameter - 6 bladed, flat bladed, disc turbine
Agitation 770 rpm
Solvent for predilution, stage injection and filter wash: MEK/toluene 55/45 LV%
Solvent injected into stage at −20°F.
Filter temperature, +5°F. Wash = ½ Filter Time.

| Run No. | Predilution V/V | Cloud Point °F. | Dilution Chilling Start °F. | Dilution Chilling End °F. | Dilution End V/V | Wash Feed V/V | Performance DWO Filter Rate USG/ft²-hr.(a) | Performance DWO Yield wt.% on feed | Performance Feed Filter Rate USG/ft²-hr.(a) | DWO Pour Point °F. |
|---|---|---|---|---|---|---|---|---|---|---|
| 1 | 0 | 150 | 155 | 26 | 3.38 | .59 | 1.20 | 77.1 | 1.52 | 18 |
| 2 | 0 | 150 | 155 | 16 | 3.83 | .96 | 1.31 | 84.9 | 1.59 | — |
| 3 | 0.25 | 140 | 145 | 25 | 3.56 | .56 | 1.15 | 80.5 | 1.48 | 20 |
| 4 | 0.50 | 134 | 140 | 39 | 3.67 | .59 | 1.47 | 78.5 | 1.86 | — |
| 5 | 0.75 | 130 | 135 | 46 | 3.64 | .76 | 2.05 | 79.2 | 2.54 | — |
| 6 | 1.00 | 128 | 133 | 48 | 3.67 | .68 | 2.23 | 78.7 | 2.81 | 19 |
| 7 | 1.25 | 127 | 132 | 58 | 3.69 | .72 | 2.42 | 78.5 | 3.05 | 17 |
| 8 | 1.50 | 127 | 131 | 64 | 3.90 | .79 | 2.23 | 78.7 | 2.87 | 16 |

Note: (a)USG refers to United States Gallons.

EXAMPLE 2

The experiments disclosed in Example 1 supra, were rerun in a continuous 16 stage pilot unit, comprised of a 6 inch diameter tower, equipped with 2 inch diameter, 6 blade-flat blade disc turbine impellers.

Experiments were also conducted in which the predilution solvent was toluene and the composition of the MEK/toluene dewaxing solvent was adjusted to give the desired end solvent composition of MEK/toluene, i.e., 55/45 LV%, at the desired final solvent/feed ratio of 4/1.

The data displayed below in Table II relate degree of predilution, cloud point reduction in the oil stock and process performance as measured by filtration rate. The data are displayed for the lab single stage equipment in addition to the pilot plant 16 stage dilution chilling tower.

that splitting of solvents such as is necessitated when toluene alone is used as a predilution solvent and methylethyl ketone/toluene is used in the dewaxing phase of the cooling operation is avoided. Uniformity of solvent composition throughout the predilution and dewaxing phases of the process is an obvious desired process objective.

EXAMPLE 3

This example relates to experiments done with methylisobutyl ketone and methylethyl ketone/methylisobutyl ketone predilution solvents. The experiments were performed in the laboratory single stage units described previously and the data were obtained using the same Aramco 2500 bright stock. The same composition was used for both predilution and subcloud point cooling. The data are tabulated below in Table III.

TABLE II

| Predilution V/V. | Cloud Point °F. Toluene | Cloud Point °F. MEK/Tol (55/45) | Feed Filter Rate USG/ft²-hr. Pilot Unit Toluene* | Feed Filter Rate USG/ft²-hr. Pilot Unit MEK/Tol (55/45) | Feed Filter Rate USG/ft²-hr. Lab Single Stage Toluene* | Feed Filter Rate USG/ft²-hr. Lab Single Stage MEK/Tol (55/45) |
|---|---|---|---|---|---|---|
| 0 | 149 | 149 | 2.2 | 2.2 | 1.6 | 1.6 |
| 0.5 | 132 | 135 | — | 3.2 | 1.9 | 1.9 |
| 1.0 | 123 | 128 | 3.0 | 4.2 | 2.5 | 2.8 |
| 1.5 | 116 | 127 | — | 4.8 | 3.2 | 2.9 |

*Composition of predilution solvent. Solvent composition to tower adjusted to give outlet MEK/Tol (55/45).

The data indicate that predilution is an effective means for increasing the overall filtration rate in the dewaxing of waxy residual feedstocks. Additionally, the data indicate that predilution solvent systems such as

TABLE III

KETONE DILUTION CHILLING DEWAXING
ARAMCO 2500 BRIGHT STOCK
EFFECT OF PREDILUTION ON DWO FILTER RATE

Lab single stage simulation of 16 stage dilution chilling. Same solvent composition used for predilution and subcloud point cooling. Dilchill solvent temperature −20°F. Agitation 770 rpm (2" impeller) chilling rate 2°F/minute Solvent/feed to filter 4/1.

| | MEK/MIBK 25/75 | MIBK | MEK/toluene 55/45 |
|---|---|---|---|
| Filter Temp, °F. | +10 | +10 | +5 |
| Predilution V/V | FR* USG/ft²-hr. | FR* USG/ft²-hr. | FR* USG/ft²-hr. |
| .0 | 1.3 | 1.1 | 1.0 |
| 0.5 | 1.5 | 1.2 | 1.2 |
| 1.0 | 1.8 | 1.8 | 1.7 |
| 1.6 | 1.9 | 1.7 | 1.7 |

*DWO Filter Rate, wash = filter time, relative to MEK/toluene case with no predilution The data indicate that a similar beneficial effect of predilution on the filter rate was obtained using all three solvents.

EXAMPLE 4

This example demonstrates the performance advantage obtained by in situ predilution. The experiments were carried out in the laboratory single stage unit, and the Aramco 2500 bright stock waxy raffinate, described in Example 1, was introduced into the chilling zone in the absence of solvent. Dilution chilling was performed with −20°F. MEK/toluene (55/45 LV%) and the effect of varying the feed temperature on effective predilution and performance is shown in Table IV below.

TABLE IV

EFFECT OF 'IN SITU' PREDILUTION ON MEK/TOLUENE DILUTION CHILLING DEWAXING ARAMCO 2500 BRIGHT STOCK

| | Initiation of Wax Crystallization | | | |
|---|---|---|---|---|
| Feed Temperature, °F. | In stage number | Solvent/Feed* V/V in Stage | Stage Temperature, °F. | Feed Filter Rate USG/ft²-hr. |
| 155 | 1 | .06 | 147 | 1.6 |
| 176 | 4 | .29 | 138 | 1.9 |
| 189 | 6 | .51 | 130 | 2.6 |

*Effective predilution

The data confirm that in situ predilution is an alternative means of increasing the overall filtration rate in the dewaxing of residual feedstocks, although it suffers from the disadvantage that less effective use is being made of the first few stages prior to wax crystallization.

EXAMPLE 5

This example illustrates the detrimental effect of predilution on a phenol extracted distillate feedstock from a Western Canadian Crude. The feedstock contained less than 5% of material boiling below 660°F. or above 890°F., and its viscosity at 210°F. was 41 SUS. The initial feed pour and cloud points were 90°F. and 95°F. respectively, and it required the removal of 22% dry wax to yield a lubricating oil with a 0°F. pour point. The process conditions are disclosed in Table V. The data typify the effect of predilution on distillates.

TABLE V

MEK/MIBK DILUTION CHILLING ON A DISTILLATE FROM A WESTERN CANADIAN CRUDE

Effect of Predilution Ahead of Tower
Lab single stage simulation of 16 stage diultion chilling. Solvent MEK/MIBK 50/50 LV% for predilution and as dilchill solvent. Dilution chilling solvent at −20°F. Agitation 1130 rpm. Chilling rate 2°F./min. Filtered at 0°F.

| | Solvent/Feed (wt/wt) | | | Performance | |
|---|---|---|---|---|---|
| Run No. | In Feed to tower (predilution) | to filter | as Wash to filter | DWO Filter Rate USG/ft²-hr. | DWO Yield Wt.% on feed |
| 1 | 0 | 2.39 | 1.05 | 8.6 | 77.2 |
| 2 | 0.25 | 2.39 | 0.77 | 7.5 | 67.0 |
| 3 | 0.50 | 2.45 | 0.76 | 7.2 | 63.7 |
| 4 | 0.75 | 2.45 | 0.77 | 7.6 | 63.7 |
| 5 | 1.00 | 2.50 | 0.64 | 7.7 | 58.8 |

EXAMPLE 6

In this example, the feedstock was a phenol-extracted distillate from a Western Canadian crude, with 45% of material boiling below 950°F., 85% of material boiling below 1050°F., and also characterized by having a viscosity of 63.1 SUS at 210°F. and requiring removal of 19% dry wax to yield a lubricating oil of +20°F. pour point. The initial feed pour point was 125°F. and the initial feed cloud point was 130°F. In one instance, the feed was introduced into the 16 stage dilution chilling pilot unit, described in Example 2, at 135°F., while in another instance the feed was introduced into the 16 stage pilot unit at 155°F. under in situ predilution conditions. Other conditions, and the deleterious effect on performance of in situ predilution obtained by elevating the feed temperature is illustrated in Table VI below.

TABLE VI

DILUTION CHILLING DEWAXING A

WESTERN CANADIAN DISTILLATE
EFFECT OF 'IN SITU' PREDILUTION

16 Stage pilot unit, 2" impellers. Solvent MEK/MIBK 45/55 LV%. Dilchill solvent at −20°F. Agitation TABLE VI-continued

| DILUTION CHILLING DEWAXING A WESTERN CANADIAN DISTILLATE EFFECT OF 'IN SITU' PREDILUTION | | |
|---|---|---|
| 1130 rpm. Chilling rate 2°F./min. Filter at +20°F. | | |
| Feed Temperature, °F. | 135 | 155 |
| Initial wax cloud point reached at: | | |
| - stage number | 1 | 4 |
| - stage temperature, °F. | 128 | 126 |
| - solvent/feed (effective predilution) | .06 | .27 |
| Solvent/Feed | | |
| - to filter | 2.8 | 2.7 |
| - to wash* | 1.1 | 0.8 |
| DWO Filter Rate, USG/ft²-hr.* | 4.8 | 4.2 |
| DWO Yield, wt.% on feed* | 77.2 | 67.8 |

*Wash time = filter time

EXAMPLE 7

This example illustrates the favorable response of broadcut feedstocks to predilution in the dilution chilling dewaxing processes.

The feedstocks used in this example were all broadcuts that were derived from Arabian crudes and had been deasphalted, hydrocracked and topped to give an initial boiling point of above 500°F. as shown in Table VII. The experiments were performed in the laboratory single stage units previously described.

Methylethyl ketone/toluene, 50/50 LV%, was used as both the predilution solvent and as the dewaxing solvent during the chilling operation. The chilling rate in the dilution chilling operation was about 2°F/minute and enough solvent was added during the operation to give a final solvent/feed ratio of 4/1 by volume. The filter temperature was about −15°F.

The data in Table VII clearly show that in each case, the filter rate of the oil from the wax of the dewaxed broadcut feedstock was substantially increased by prediluting the feedstock with solvent prior to the dilution chilling dewaxing operation.

TABLE VII

RESPONSE OF DEASPHALTED HYDROCRACKED BROADCUT FEEDSTOCKS TO PREDILUTION PRIOR TO DILUTION CHILLING DEWAXING

| Feedstock | A | | B | | C | |
|---|---|---|---|---|---|---|
| G-C distillation, °F[a] | | | | | | |
| I.B.P. | 570 | | 531 | | 680 | |
| 5% | 619 | | 591 | | 760 | |
| 50% | 746 | | 833 | | 943 | |
| 90% | 1076 | | 990 | | 1088 | |
| API gravity | 31.5 | | 31.9 | | 31.6 | |
| Cloud Pt., °F | 134 | | 126 | | 136 | |
| Visc. SUS at 100°F | 201 | | 204 | | — | |
| SUS at 210°F | 47 | | 48 | | 65.9 | |
| VI | 110 | | 110 | | — | |
| Predilution[b] | 0 | 1.0 | 0 | 1.0 | 0 | 1.0 |
| Feed filter rate | 4.2 | 6.8 | 2.8 | 4.7 | 1.8 | 3.0 |

TABLE VII-continued

RESPONSE OF DEASPHALTED HYDROCRACKED BROADCUT FEEDSTOCKS TO PREDILUTION PRIOR TO DILUTION CHILLING DEWAXING

| Feedstock | A | B | C |
|---|---|---|---|
| (USG/ft²-hr) | | | |

Notes:
[a]ASTM D-2887-70T. (Boiling Range Distribution of Petroleum Fractions by Gas Chromatography.)
[b]Solvent/feed, volume basis.

What is claimed is:

1. A process for dewaxing a waxy petroleum oil feedstock comprising a waxy, deasphalted and topped crude oil the major portion of which boils above about 650°F. and which contains at least about 10 wt. % of residual material which process comprises:
   a. mixing said oil stock with between about 0.3 and 2 volumes of a predilution solvent per volume of said oil stock, thereby depressing the cloud point of said oil stock and forming a first mixture comprising said predilution solvent and said oil stock;
   b. introducing said first mixture at a temperature above the depressed cloud point of said oil stock into a cooling zone divided into a plurality of stages and passing said mixture from stage to stage of said cooling zone;
   c. introducing dewaxing solvent into at least a portion of said cooling zone at a plurality of spaced points therealong;
   d. mixing said dewaxing solvent with at least a portion of said first mixture as it passes from stage to stage of said cooling zone under conditions of high agitation, thereby forming a second mixture comprising said dewaxing solvent, said predilutionsolvent and said oil stock; and
   e. cooling said oil stock contained in said second mixture as it passes from stage to stage of said cooling zone, thereby reducing the temperature of said oil stock to below its depressed cloud point and precipitating at least a portion of said wax therefrom under said conditions of high agitation.

2. The process of claim 1 wherein said residual material has an initial boiling point above about 1,000°F at atmospheric pressure.

3. The process of claim 1 wherein the solvent in step (a) is a dewaxing solvent that is selected from the group consisting of aliphatic ketones containing from 3–6 carbon atoms per molecule, the lower molecular weight hydrocarbons, aromatic compounds, halogenated lower molecular weight hydrocarbons and mixtures thereof.

4. The process of claim 3 wherein said solvent is selected from the group consisting of methylethyl ketone, methylisobutyl ketone, toluene and mixtures thereof.

5. The process of claim 1 wherein the solvent used in step (a) is a dewaxing solvent and is the same as or different than the dewaxing solvent used in step (c).

6. The process of claim 1 wherein the degree of agitation is sufficient to provide substantially instantaneous mixing of solvent and oil.

7. The process of claim 1 wherein the dewaxing solvent used in step (c) is prechilled prior to introduction into said cooling zone.

* * * * *